United States Patent [19]

Fields et al.

[11] Patent Number: 5,076,344

[45] Date of Patent: Dec. 31, 1991

[54] DIE-CASTING PROCESS AND EQUIPMENT

[75] Inventors: James R. Fields; Men G. Chu, both of Export; Lawrence W. Cisko, Irwin; C. Edward Eckert, Plum Borough; George C. Full, Murrysville; Thomas R. Hornack, Lower Burrell; Thomas J. Kasun, Pittsburgh; Jerri F. McMichael, Pittsburgh; Richard A. Manzini, Greensburg; Janel M. Miller, Lower Burrell; M. K. Premkumar, Monroeville; Thomas J. Rodjom, Murrysville, all of Pa.; Gerald D. Scott, Massena, N.Y.; William G. Truckner, Avonmore, Pa.; Robert C. Wallace, New Kensington, Pa.; Mohammad A. Zaidi, Monroeville, Pa.

[73] Assignee: Aluminum Company of America, Pittsburgh, Pa.

[21] Appl. No.: 320,140

[22] Filed: Mar. 7, 1989

[51] Int. Cl.[5] ..... B22D 18/08; B22D 18/00

[52] U.S. Cl. ..... 164/457; 164/61; 164/113; 164/258; 164/312

[58] Field of Search ..... 164/4.1, 150, 253, 254, 164/256–258, 312, 316, 457, 72, 61, 113, 119

[56] References Cited

U.S. PATENT DOCUMENTS

| | | | |
|---|---|---|---|
| 2,393,588 | 1/1946 | Cherry et al. | 164/316 |
| 2,864,140 | 10/1955 | Morgenstern . | |
| 2,977,649 | 3/1959 | Mortan . | |
| 3,008,202 | 4/1960 | Bauer . | |
| 3,009,218 | 11/1961 | Rearwin . | |
| 3,013,315 | 12/1961 | Smith, Jr. | 164/256 |
| 3,254,377 | 6/1966 | Morton . | |
| 3,544,355 | 12/1970 | Ott | 164/312 |
| 3,613,772 | 10/1971 | Carr . | |
| 3,830,280 | 8/1974 | Larsen . | |
| 3,901,306 | 8/1975 | Miki et al. | 164/312 |
| 3,920,099 | 11/1975 | Pondelicek et al. . | |
| 4,061,176 | 12/1977 | Carbonnel | 164/312 |
| 4,154,288 | 5/1979 | Borgen | 164/312 |
| 4,223,718 | 9/1980 | Miki et al. . | |
| 4,240,497 | 12/1980 | Glazunov et al. . | |
| 4,334,575 | 6/1982 | Miki et al. . | |
| 4,476,911 | 10/1984 | Lossack et al. | 164/257 |
| 4,534,403 | 8/1985 | Harvil | 164/316 |
| 4,562,875 | 1/1986 | Ogoshi et al. | 164/312 |
| 4,660,614 | 4/1987 | Spriestersbach et al. . | |
| 4,667,729 | 5/1987 | Zecman | 164/312 |
| 4,738,297 | 4/1988 | Takagi et al. . | |
| 4,754,799 | 7/1988 | Robinson | 164/312 |
| 4,766,948 | 8/1988 | Behr et al. . | |
| 4,842,039 | 6/1989 | Kelm . | |
| 4,854,370 | 8/1989 | Nakamura | 164/312 |
| 4,886,107 | 12/1989 | Zecman | 164/312 |
| 4,899,804 | 2/1990 | Hammerer | 164/312 |

FOREIGN PATENT DOCUMENTS

| | | | |
|---|---|---|---|
| 2553807 | 11/1976 | Fed. Rep. of Germany | 164/256 |
| 46779 | 12/1978 | Japan | 164/312 |
| 163068 | 12/1981 | Japan | 164/312 |
| 163069 | 12/1981 | Japan | 164/312 |
| 178166 | 10/1984 | Japan | 164/316 |
| 216961 | 10/1985 | Japan | 164/312 |
| 1023561 | 2/1986 | Japan | 164/457 |
| 118955 | 5/1987 | Japan | 164/312 |
| 137163 | 6/1987 | Japan | 164/312 |
| 281772 | 9/1970 | U.S.S.R. | 164/312 |
| 306163 | 7/1971 | U.S.S.R. . | |
| 638416 | 12/1978 | U.S.S.R. . | |
| 844113 | 8/1960 | United Kingdom | 164/254 |

*Primary Examiner*—Richard K. Seidel
*Assistant Examiner*—Edward A. Brown
*Attorney, Agent, or Firm*—Daniel A. Sullivan, Jr.; Richard Westerhoff

[57] ABSTRACT

This invention provides improved casting processes, equipment, and products. The invention is especially advantageous for die casting.

31 Claims, 10 Drawing Sheets

DIE-CASTING PROCESS AND EQUIPMENT

DESCRIPTION

1. Technical Field

This invention relates to casting processes, especially die-casting processes, and to equipment for, and products made by, such processes. The invention has particular application to that branch of the die-casting field where vacuum is used to facilitate the die-casting operation and/or enhance the product.

2. Background of Invention

Morgenstern disclosed a vacuum die-casting machine in U.S. Pat. No. 2,864,140.

A vacuum die-casting machine of design similar to that of the Morgenstern machine is described in U.S. Pat. No. 4,476,911 assigned to Machinenfabrik Mueller-Weingarten A.G. of Weingarten, West Germany.

DISCLOSURE OF INVENTION

This invention provides improved casting processes, equipment, and products. The invention is especially advantageous for die casting.

A die-casting process incorporating this invention involves the following considerations:

1. Composition of the material being die cast
2. Melting practice, including degasification and filtration of the melt
3. Supply of the molten material to the die casting machine
4. The fill chamber section
5. Lubricants and coatings for the fill chamber and die
6. The casting, including its cleanup, heat treatment and properties Considerations involved in each of these topics are as follows:

1. Composition of the material being die cast

While portions of this invention will be applicable to the die casting of any material, for instance zinc and zinc alloys, and even plastics, others will find preferred embodiments in conjunction with certain alloys of aluminum, one especially advantageous example being an aluminum-silicon (Al-10%Si) casting alloy of the following percentage composition:

Si 9.5–10.5
Mg 0.11–0.16
Fe 0.3 to 0.4
Sr 0.015–0.030
Remainder Al.

Other elements may be present, some as impurities, some to serve special purposes. For instance, Ti may be present, for instance in the range 0.05–0.10 percent, for grain refining purposes; B may also be present for reasons of grain refinement. For one exemplary alloy, a reasonable limit for such other elements is that they not exceed a total of 0.25 percent. Another choice of limits might be: Others each 0.05% max, others total 0.15% max.

All parts and percentages appearing here and throughout are by weight unless otherwise specified.

In general, the functions of the constituents of the alloy are as follows. The silicon lends fluidity to the melt for facilitating the casting operation, as well as imparting strength to the casting. The strontium provides a rounding of the silicon eutectic particles for enhancing ductility. Magnesium provides hardening during aging based on $Mg_2Si$ precipitation.

Iron lowers the hunger (based on considerations of chemical thermodynamics) of the aluminum for iron and thus suppresses soldering of the alloy to the iron-based mold and to iron-based conduits or containers on the way to the mold. Soldering leads to sticking of the cast part to the die, surface roughening of dies and of the walls of die-casting-machine fill chambers, to breakdown of sealing, to wear of the pistons of die-casting machines, and to surface roughening on the castings matching the surface roughening of the dies.

Soldering is particularly a problem in the casting of die castings, which have high gate velocities relative to other casting techniques. Die-castings, in general, have a metal velocity through the gate of about 50 feet/sec or above, for instance in the range 100 to 150 feet/sec (30 to 45 meters/sec). High gate velocities may be necessary for a number of reasons. For instance, thin gates are of advantage and desired for mass-produced die castings, because it is then easy simply to break the gate material away from the casting during clean-up. Unfortunately, thin gates (maximum thickness ≦ about 2 millimeters) necessitate high metal flow velocities through them, and higher metal pressures and temperatures, particularly in the casting of complexly shaped parts, and these conditions have all been found to promote soldering. Another reason for high gate velocities can be the need to get complete filling of a mold for making a thin-walled casting.

The commonly used countermeasure against soldering is increased iron content, up to 1, or even 1.1, % iron.

The iron compositional range for compositions preferred for use in this invention is low compared to the usual iron level used for high-gate-velocity die castings. This represents an important aspect of this invention, the discovery of ways to die-cast lower-iron, non-ferrous, e.g. light metal, or aluminum, high-gate-velocity die castings. Thus, to the extent iron is present, it can have a deleterious effect on ductility of the alloy and on the ability of cast parts to withstand crush tests. As a basic rule of thumb, the lower the iron content can be kept, the better for purposes of high yield strength and crush resistance. The ability to achieve high-gate-velocity die-casting production runs of commercially acceptable duration, as provided by this invention for low-iron aluminum casting alloys, makes even more attractive the idea of vehicle manufacture based on aluminum structures. For example, the joints of an automotive space-frame such as disclosed in U.S. Pat. No. 4,618,163 can be the die-castings of the present invention.

In contrast, low-gate-velocity, thick-gate castings may be die-cast without too much worry of causing soldering. Of course, then the gates have to be sawed off, rather than broken off. Iron contents in the 0.3–0.4% range are used in low-gate-velocity die casting, and iron may even be as low as 0.15%.

Given that some iron must be present if, for instance, iron-based dies are to be used, and especially in the case of high-gate-velocity die casting, it can be of advantage to add to the above composition certain elements which will alter the effect of the iron on mechanical properties. For instance, an element may be added for affecting morphology of the plate-shaped iron-bearing particles from a platelet shape to a more spheroidized shape. Elements which are considered as candidates for altering the effect of iron are Ni, Co, Be, B, Mn, at levels about in the range 0.05 to 0.1, 0.2, or even 0.25 percent.

As indicated at the beginning of this section, other compositions can be used in conjunction with the present invention. For instance, iron may be varied in the range beginning at 0.5% downwards, and, in some instances, iron may be as low as 0.2%, perhaps even down to 0.1%. Silicon may be decreased to around 8%. And, magnesium may be brought down to 0.10%. Thus, an alternate composition may be:

Si 7.5–8.5
Mg 0.08–1.2
Fe 0.15–0.25
Sr 0.015–0.025
Remainder Al.

For certain applications, the present invention can as well be applied to the die-casting of the class of aluminum alloys containing 5–10% magnesium.

Alloy products which can be cast in varying embodiments of the invention are: 369.1, 409.2, and 413.2, as listed in the Registration Record of Aluminum Association Alloy Designations and Chemical Composition Limits for Aluminum Alloys in the Form of Castings and Ingots, published by the Aluminum Association, Washington, D.C.; Silumin-Kappa and Silumin-Delta of Vereinigte Aluminium-Werke, Bonn, West Germany; and strontium-modified Al-Si11Mg Alloy 61S of Aluminium Pechiney, Paris, France.

2. Melting practice, including degasification and filtration of the melt

Material (such as the Al-10%Si alloy described above) of the correct composition is melted, adjusted in composition as required, and then held for feed to a die-casting machine as needed.

Adjustment of composition comprises three parts: Removal of dissolved gas, addition of alloying agents, and removal of solid inclusions.

In the case of aluminum alloy, for example, it is important for a number of reasons, such as the obtaining of excellent mechanical properties, avoidance of blistering during heat treatment, and good welding characteristics, that the molten metal be treated for removal of dissolved hydrogen. There are different ways of doing this, such as vacuum melting, reaction with chlorine bubbled into the melt, or physical removal by bubbling an inert gas, such as argon, through the melt. Chlorine additionally removes sodium and produces a dry skim of aluminum oxide, the dryness being of advantage for good removal of the skim, in order to avoid solid inclusions in the castings. A skim which is wet by the molten aluminum is more difficult to remove.

Strontium addition for modifying the shape of silicon phase may be added to the molten metal at a point where the molten metal is moving, in order to get good heat transfer into the solid master alloy and also to get good distribution of the strontium throughout the melt. Strontium may be added, for instance, in the form of master alloy wire of composition 3% Sr, balance aluminum, to a trough where the melt is flowing from a ladle where melting and hydrogen removal was performed to a holding furnace where the melt is stored preparatory to casting. Because chlorine reacts with Sr, it is beneficial to bubble inert gas, such as argon, for example, through the melt following the fluxing with chlorine, in order to remove chlorine as much as possible before the Sr addition.

There is an incubation period needed following addition of Sr. Until the incubation period has been passed through, silicon morphology modification is insufficient. There is also a point in time after which the melt becomes stale, in that the action of the Sr is no longer effective for silicon shape modification. When this point arrives, casting is discontinued. At a molten metal temperature of 1320° to 1400° F., the incubation period can amount to about 5 minutes. At a holding temperature of 1320° F., there will be a residence time of e.g. 6 to 7 hours during which silicon modification is satisfactory; following such residence time, the melt becomes stale.

Solid inclusions not eliminated by skim removal in the melting ladle are removed by filtration, for example through ceramic foam or particulate filters. This may be carried out as the melt moves from the trough into the container in the holding furnace. In the case of aluminum alloys, it is advantageous to limit inclusions to, for example, $\leqq$one 20-$\mu$ inclusion per cc.

3. Supply of the molten material to the die casting machine

Molten material is brought from the holding furnace to the die casting machine through a suction tube. The suction tube preferably extends into a region of the holding furnace container where, as melt is removed for casting, melt pressure head causes melt replenishment to move through a filter into such region. The suction tube extends from the holding furnace to a fill, or charging, chamber, also called a shot sleeve, at a hole in the fill chamber referred to as the inlet orifice.

The suction tube is preferably made of graphite (coated for protection against oxidation on its outer surface) or ceramic, for preventing iron contamination of the melt and for facilitating suction tube maintenance.

A ceramic, e.g. boron nitride, inlet orifice insert may be used to reduce heat transfer, thus guarding against metal freezing in the inlet orifice, and to reduce erosion at that location. This may be coupled with a ceramic insert in the shot sleeve in the area of the inlet orifice, also to prevent erosion. Erosion may be handled, as well, with an H13-type steel replacement liner at such location.

An electric inlet orifice heater also may be used to guard against metal freezing at the inlet orifice. This so-called pancake heater operates in the manner described below.

A moat in the fill chamber wall may also be used for reducing heat transfer out of the area of the inlet orifice.

A secondary, crushable, die-formed (by ribbon compression) graphite-fiber seal at the inlet orifice outside of primary seals may be used to guard against air leakage at the primary seals into the melt at the junction between the suction tube and the shot sleeve.

4. The fill chamber section

Several important aspects of the die-casting process involve the fill, or charging, chamber, or shot sleeve, of the die-casting machine. For instance, the fill chamber seats a piston, or ram, which is preferably made of beryllium copper. The piston serves for driving melt from the fill chamber to the die, or mold. Additionally associated with this section of the die-casting machine are means for applying coatings or lubricants to occupy the interfaces between the fill chamber and piston and between the fill chamber and the melt.

a. The piston

Several features of the fill chamber section contribute particularly to high quality die castings. As regards the piston, one important aspect involves protection from its being a source of harmful gases, for instance air from the environment, leaking into the molten material contained under vacuum in the fill chamber. The piston must be able to execute its different functions of first containing and then moving the melt to the die. It must be movable and yet sealed as much as possible against the encroachment of contamination into melt contained in the fill chamber.

Advantageous features provided for the piston in the present invention include 1) aspects of sealing, 2) a joint between the piston and the piston rod, and 3) measures taken to control temperature to stabilize the sliding fit between the fill chamber bore and the piston exterior.

According to a preferred mode of sealing around the piston, the seal extends between the fill chamber and the piston rod. This feature assures sealing for as long as desired during piston travel.

In a further development of the sealing of the piston, a flexible envelope between the fill chamber and the piston rod accommodates different alignments of the piston and rod. This arrangement also prevents damage to sealing gaskets by aluminum solder or flash which is generated by movement of the piston.

In another embodiment, the piston includes a flexible skirt for fitting against variations in the bore of the fill chamber, in order to better seal the piston-fill chamber bore interface against gas leakage into melt in the fill chamber.

A swivel, or ball, joint, or articulation, between the piston and the piston rod may also be provided to allow the piston to follow the bore of the fill chamber.

The piston is cooled, this assisting, for instance, in freezing the so-called bisquit against which it rams in the final filling of the die.

Temperature, particularly temperature differences between the piston and the fill chamber bore, is controlled, to resist contamination of the melt by gas leaking through the interface between piston and bore. Measures used include direct monitoring and controlling of piston temperature, which in turn permits control of cooling fluid flow to the piston based on timing or cooling fluid temperature.

b. The fill chamber itself

The fill chamber itself, like the die, may be made of H13 steel, which preferably has been given a nitride coating using the ion-nitriding technique.

The fill chamber may optionally have ceramic lining for providing decreased erosion, reduced release agent (lubricant) application or reduced heat loss. While the invention as disclosed is presented mainly in the context of so-called "cold chamber" technology, i.e. die machine temperatures such that the metal from the holding furnace is basically losing heat as it moves to the die, use of "hot chamber" technology, where the fill chamber, for instance, has about the same temperature as the molten metal, will act to guard ceramic liners against spalling and other degradation due to temperature gradients. Ceramic liners provide compositional choices not subject to the aluminum-iron interaction and can, therefore, stay smooth longer, this being of advantage, for instance, for preventing wear in the flexible skirt.

The fill chamber section additionally includes means for applying and maintaining vacuum. Vacuum is achieved by adequate pumping and, even more importantly, it is maintained by attention to sufficient sealing. In general, it is poor practice to increase pumping and not give enough attention to the seals. Insufficient sealing will mean larger amounts of gas sweeping through the evacuated fill chamber and a concomitant risk of melt contamination. Vacuum quality may be monitored by pressure readings (vacuum levels are kept at 40 to 60 mm Hg absolute, preferably less than 50 mm absolute, down to even less than 20 mm Hg absolute) and additionally by measures such as gas tracing, for instance argon tracing, and gas mass flow-metering, under either feedback or operator control.

c. Means for applying coatings or lubricants

An important aspect of the fill chamber section involves the application of coatings or lubricants. Measures such as ion nitriding are done once and serve for making many castings. Other coatings and lubricants are applied often, for instance before the forming of each casting.

Coatings and lubricants may be applied manually, using nozzles fed by the opening of a valve by hand squeeze. Or, they may be applied by use of so-called "rider tubes" which ride with the piston to lubricate the bore of the fill chamber. Rider tubes typically involve the use of a non-productive piston stroke between each die feeding stroke for lubricating the fill chamber bore preparatory for the next filling of melt into the fill chamber.

According to one especially advantageous embodiment of the invention, a fill chamber die-end lubricator is provided. It is called a "die-end" lubricator, because it accesses the fill chamber bore from the end of the fill chamber nearest the die, when the die halves are open. The die-end lubricator eliminates the non-productive stroke. Other important advantages of the die-end lubricator are uniform, thorough application of coatings and lubricants, the drying of the water component of water-based coatings and lubricants, and the sweeping, or evacuation, of solder, or flash, from the fill chamber bore by pressurized gas blow.

5. Lubricants and coatings for fill chamber and die

The lubricants and coatings used in the present invention for fill chamber and die have been found to be especially advantageous for enabling high pressure die casting of parts in low iron, precipitation hardenable aluminum alloy. The die castings have low gas content and can be heat treated to states of combined high yield strength and high crush resistance.

Both fill chamber bore and the cast-metal-receiving faces of the die are preferably given a nitride coating using the ion-nitriding technique. Ion nitriding, also known as plasma nitriding, is a commonly utilized surface treatment in die casting. Ion nitriding is used in conventional die casting mainly to reduce die wear caused by high velocity erosion. According to the invention, this surface treatment of the fill chamber bore and the die, preferably in combination with the use of lubricant, especially the halogen-salt-containing lubricant of the invention, has been found to be particularly effective for inhibiting soldering in the high pressure die casting of low iron, precipitation hardenable aluminum alloy.

Lubrication is important for long and successful runs which avoid soldering, i.e. attack of the steel fill chamber and die walls by aluminum alloy melt. Thus, while die and sleeve lubricants for the most part have very different functions, both lubricants have the common function that they must minimize the soldering reaction.

The present invention adds a halogenated salt of an alkali metal to die and fill chamber lubricants to achieve a marked reduction in soldering, particularly in the case of die-casting low-iron aluminum silicon alloys. For instance, potassium iodide added to lubricant (2 to 7% in sleeve lubricant and 0.5 to 3% in die lubricant) inhibits the formation of solder buildup and enables a reduction in the lubricating species, for instance organic, required for performance. The lubricating species in the water-based lubricants to which it is added (emulsion, water soluble synthetic, dispersion, or suspension) only serve to provide the friction reduction required for part release on the die and heat transfer reduction in the sleeve. An example of lubricating species is polyethylene glycol at 1% in the water base. Graphite is another lubricating species, which may be added to facilitate release of the castings from the die.

Lubricants containing halogenated salt of alkali metal provide an overall reduction in gas content in the cast parts.

An important step in the reduction of the gas content in these castings has been the development of the herein described die-end lubricator equipment to apply lubricant to the fill chamber bore. The equipment enables the use of water based lubricants for the bore. Thus, the die-end lubricator has brought consistency to the lubricant application and provides the ability to apply inorganic materials, such as potassium iodide. Importantly, steam generated by the evaporation of the water is removed from the sleeve by the sweeping action of the drying air emitted from its nozzle.

6. The casting, including its cleanup and heat treatment and properties

Upon removal of the casting from the die, the casting may be allowed to cool to room temperature and sand blasted, if desired, for removing surface-trapped lubricant, to reduce gas effects during subsequent treatment, for instance to reduce blistering during subsequent heat treatment and outgassing during welding.

Heat treatment of die castings of the Al-10%Si aluminum alloy, for instance, is designed to improve both ductility and strength. Heat treatment comprises a solution heat treatment and an aging treatment.

Solution treatment is carried out in the range 900° to 950° F. for a time sufficient to provide a silicon coarsening giving the desired ductility and to provide magnesium phase dissolution. The lower end of this range has been found to give desired results with much reduced tendency for blistering to occur. Blistering is a function of flow stress and the lower temperature treatment (which are associated with lower flow stress) therefore helps guard against blistering. The lower end of the range also provides greater control over silicon coarsening, the coarsening rate being appreciably lower at the lower temperatures.

Aging, or precipitation hardening, follows the solution heat treatment. Aging is carried out at temperatures lower than those used for solution and precipitates $Mg_2Si$ for strengthening. The concept of the aging integrator, as set forth in U.S. Pat. No. 3,645,804, may be employed for determining appropriate combinations of times and temperatures for aging. Should the casting be later subjected to paint-bake elevated temperature treatments, the aging integrator may be applied to ascertain the effect of those treatments on the strength of the finished part.

This solution plus aging treatment has been found to permit the selection of combined high ductility and high strength, the ductility coming from the solution treatment, the strength coming from the aging treatment, such that a wide range of crush resistance, for instance in box-shaped castings, can be achieved.

As noted above, it is preferred that solution heat treatment temperatures at the lower end of the solution heat treatment temperature range be used. Time at solution heat treatment temperature has an effect. The yield strength obtainable by aging decreases as time at solution heat treatment temperature increases. Achievable yield strength falls more quickly with time at solution heat treatment temperature for the higher solution heat treatment temperatures, for instance 950° F., than is the case for lower solution heat treatment temperatures, for instance 920° F. Achievable yield strength starts out higher in the case of solution heat treatment at 950° F. but falls below that achievable by solution heat treatment at 920° F. as time at solution heat treatment temperature increases.

Casting properties following heat treatment of the above-referenced alloy are as follows:

Yield strength in tension (0.2% offset)≧110 MPa
(Yield strength being typically 102–135 MPa)
Elongation≧10% (typically 15–20%)
Free bend test deformation≧25 mm, even ≧30 mm
Total gas level≦10 ml/100 g metal
Weldability=A or B
Corrosion resistance≧EB Yield strength and elongation determined according to ASTM Method B557.

Free bend test deformation is determined using a test setup as shown in FIG. 15. The radii on the heads, against which the specimen deflects, measure 0.5 inches. The specimen, measuring 2 mm thick by 3 inches long by 0.6 inches wide, is given a slight bend, such that the specimen will buckle as shown when the loading heads are moved toward one another. For specimens thicker than 2 mm, they are milled, on one side only, down to 2 mm thickness, and bent such that the outside of the bend is on the unmilled side. The top and bottom loading heads close at a constant controlled stroke rate of 50 mm/min. Recorded a "free bend test deformation" is the number of millimeters of head travel which has occurred when specimen cracking begins. Free bend test deformation is a measure of crush resistance.

Gas level is determined by metal fusion gas analysis. A typical gas level is 5 ml/100 g metal.

Weldability is determined by observation of weld pool bubbling, using an A, B, C scale; A is assigned for no visible gassing, B for a light amount of outgassing, a light sparkling effect, but still weldable, and C for large amounts of outgassing and explosions of hydrogen, making the casting non-weldable. Alternatively, gas level is a measure of weldability, weldability being inversely proportional to gas level.

Corrosion resistance is determined by the EXCO test, ASTM Standard G34-72.

Representative of the quality of high-gate-velocity, precipitation-hardened die castings of the invention in Al-10%Si alloy are the following results of mechanical testing on die castings obtained from two runs:

| | 0.2% Yield Strength, MPa | | | Free Bend Test Deformation, mm | | |
|---|---|---|---|---|---|---|
| Run No. | Max. | Ave. | Min. | Min. | Ave. | Max. |
| 3-5Q | 141 | 130 | 120 | 37 | 42 | 44 |
| 3-5R | 139 | 129 | 125 | 39 | 42 | 46 |

BRIEF DESCRIPTION OF DRAWING

FIGS. 1 and 2 are as they appear in U.S. Pat. No. 4,476,911 referenced in the above Background of Invention.

MODES FOR CARRYING OUT THE INVENTION a. A die casting machine in general

Figure 1:
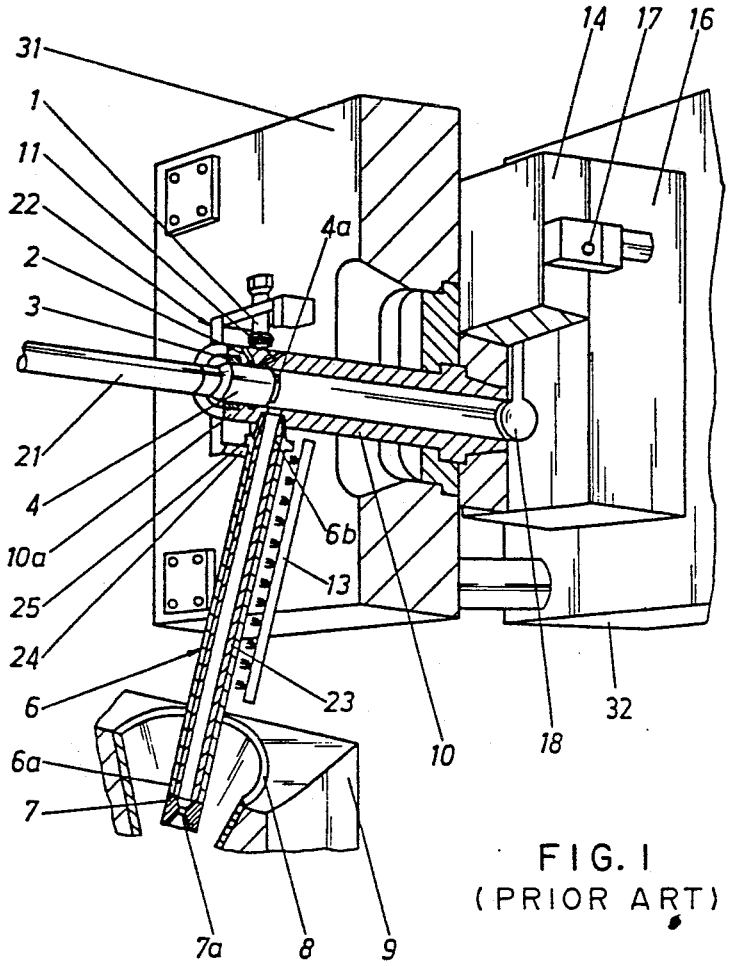
FIG. 1 (PRIOR ART)
FIG. 1 shows a perspective view, partially in section, of a die-casting machine for use in carrying out the invention.

Referring to FIG. 1, it shows essentially only the region of the fixed clamping plate 31, or platen, with the fixed die, or mold, half 14 and the movable clamping plate 32, or platen, with the movable die, or mold, half 16 of the die casting machine. To better illustrate the region of the fill chamber 10, the fixed clamping plate 31, the fixed die half 14, the fill chamber 10, the suction tube 6 and the holding furnace 9 with its container 8 are shown in a partial cut away section. Reference numeral 17 indicates the valve for connecting the vacuum to the die.

Figure 2:
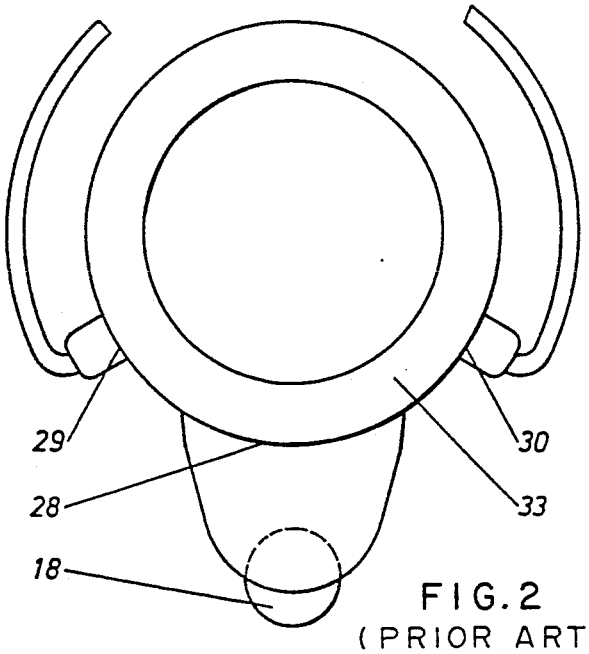
FIG. 2 (PRIOR ART)
FIG. 2 shows a cast piece in plan view.

The vacuum lines ending within the die lie above the gate section. This is better illustrated in FIG. 2 which shows a cast piece, for example a pan, with the gate region being marked 28 and the two vacuum connections 29 and 30. Desirably, gate region 28 is thin, e.g. ≦about 2 mm thick, such that it can be broken away from the cast part. The casting sprue bears the numeral 18.

Referring again to FIG. 1, the front vacuum connection in the region of the casting piston 4 is marked 2. In this region, there also ends a connection 11 for piston lubrication. A conical projection 4*a* is provided at the frontal face of the casting piston 4. The rear of the piston is connected to piston rod 21. The rear region 10*a* of the fill chamber 10 may be lined with a heat resistant packing 3 for sealing. The suction tube 6 is hung by means of a clamp 22. This clamp 22 has a lower hook-shaped tongue 24 which passes underneath an annular flange 25 on the suction tube 6. From the top, a spring bolt 1 is brought through the clamp 22. This produces an elastic clamping of the conical end 6*b* of suction tube 6 within corresponding conical surfaces at the inlet orifice of the fill chamber 10.

The reference numeral 23 identifies the insulating lining of the suction tube 6 which is chemically inert and is designed to have low wettability with respect to aluminum alloys. The suction tube 6 is heated by a heating system 13 which in the illustrated embodiment is indicated as a gas heating system. Instead of the gas heating system, an inductive or resistive heating system can also be used with preference, it being important that the heating system extends into the upper connecting region containing conical end 6*b* toward the fill chamber 10. The holding furnace 9 is designed to be adjustable in height, which, for the sake of simplicity is not shown separately.

Thus, the desired immersion depth of the suction tube 6 in the metal melt can always be assured. Likewise, to facilitate removal or exchange of the suction tube 6, the holding furnace 9 can be lowered and removed toward the side.

Reference numeral 7 indicates the choke of the suction tube 6. The actual nozzle cross section 7*a* as well as the length of the nozzle regions may here be of different design. Instead of the nozzle, a known filter material can also be used.

b. Melting equipment

Figure 3:
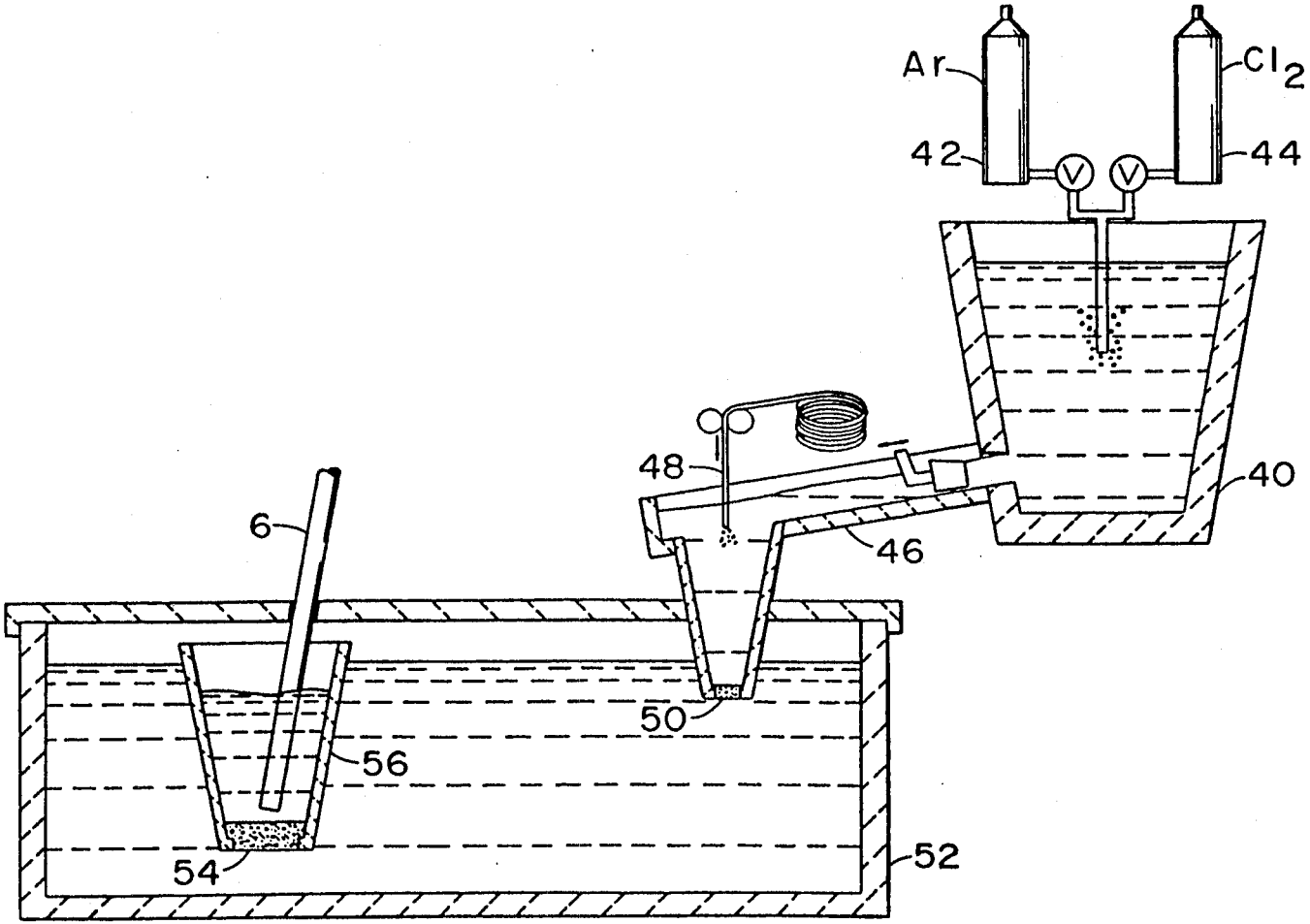
FIG. 3 is a schematic representation of melting practice according to the invention.

FIG. 3 illustrates an example of melting equipment used according to the invention for providing a suitable supply of molten Al-10%Si alloy for die casting.

Solid metal is melted in ladle 40 and fluxed, for example using a 15 minute flow of argon+3% by volume chlorine from the tanks 42 and 44, followed by a 15 minute flow of just argon. A volume flow rate and gas distribution system suitable for the volume of molten metal is used.

As needed to make up for metal cast, metal is caused to flow from ladle 40 into trough 46, where strontium addition is effected from master alloy wire 48.

The metal flowing from the trough is filtered through a coarse-pored ceramic foam filter 50 as it enters the holding furnace container 52 and subsequently through a fine-pored particulate filter 54, before being drawn through suction tube 6. Filter 54 could be placed on the bottom of tube 6 and subcompartment 56 eliminated, but the structure as shown is advantageous in that it permits the use of a larger expanse of fine-pored filter 54, this making it easier to assure adequate supply of clean molten metal for casting.

c. Inlet orifice

Figure 4:
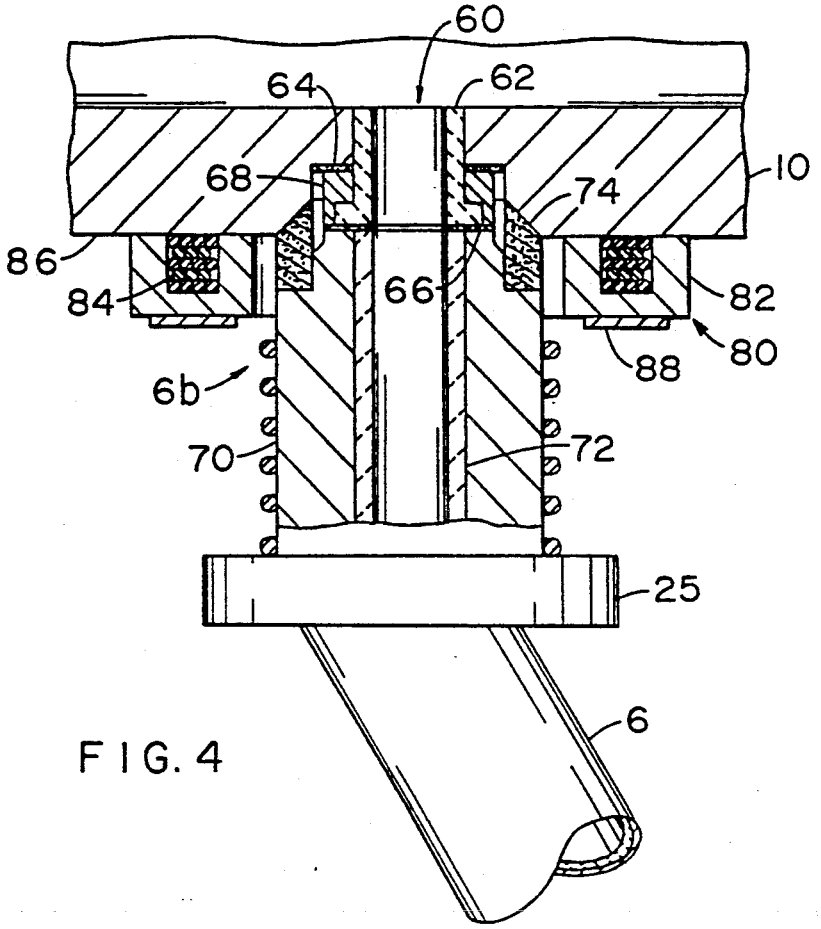
FIG. 4 is an elevational, cross-sectional, detail view of one embodiment of the region around end 6*b* in FIG. 1.

FIG. 4 shows details of an embodiment of the inlet orifice 60 in fill chamber 10. Three important aspects of this embodiment are guarding against 1) metal freezing onto the walls of the inlet orifice, 2) erosion of the walls of the inlet orifice by the molten metal flow, and 3) loss of vacuum within the fill chamber.

A boron nitride insert 62 contributes particularly to aspects 1 and 2.

Primary seals 64 and 66 contribute particularly to aspect 3, sealing the inlet orifice at seating ring 68, nipple 70, and ceramic liner 72.

Crushable, graphite-fiber seal 74 squeezed between fill chamber 10 and nipple 70 guards against air leakage at the primary seals.

Pancake heater 80 is formed of a grooved ring 82. The groove carries an electrical resistance heating coil 84. The heater is held against plane 86, which is a flat surface machined on the exterior of exterior surface of the fill chamber. Steel bands 88 encircle the fill chamber to hold the heater in place.

Figure 5:
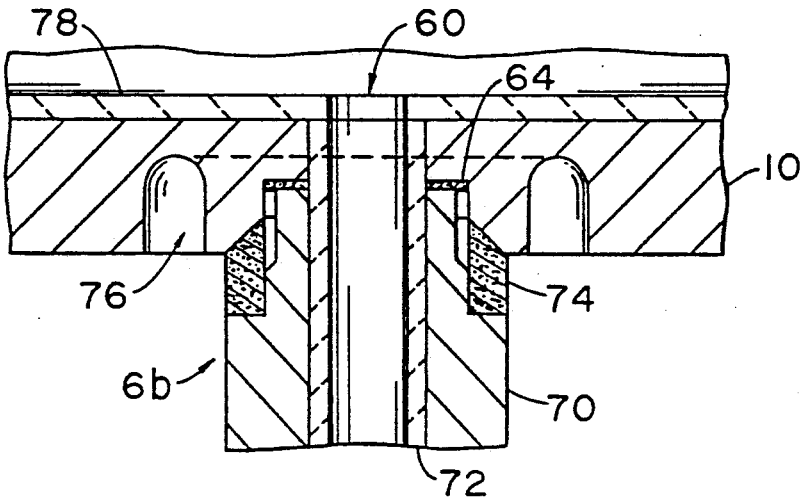
FIG. 5 is an elevational, cross-sectional, detail view of a second embodiment of the region around end 6*b* in FIG. 1.

Flange 25 is provided, in order that clamp 22 of FIG. 1 may hold end **6*b* tightly sealed against the fill chamber 10. FIG. 5 shows details of a second embodiment of the inlet orifice 60 in fill chamber 10. This embodiment illustrates the use of an air-filled moat 76** surrounding the inlet orifice. The moat mitigates the heat-sink action of the walls of the fill chamber, in order to counteract a tendency of melt to freeze and block the inlet orifice.

The embodiment of FIG. 5 also illustrates the idea of a a ceramic, or replaceable steel, liner 78 for the bore of the fill chamber.

Structural details in FIG. 5 which are the same or essentially similar to those in the embodiment of FIG. 4 have been given the same numerals used in FIG. 4.

Figure 5A:
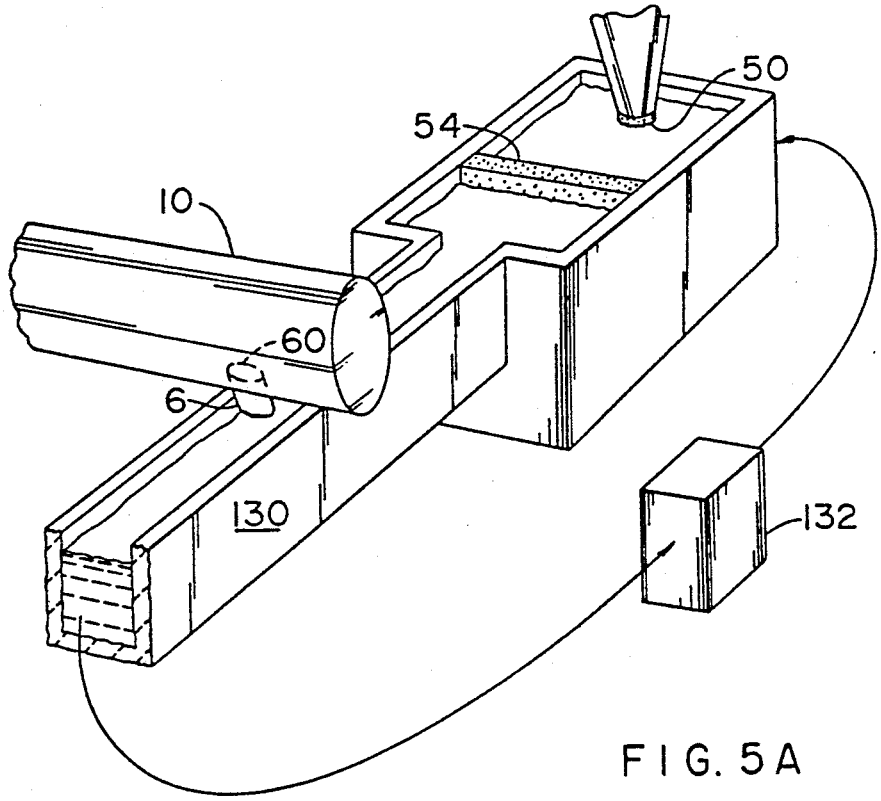
FIG. 5A is schematic, perspective view of a third embodiment of the region around end 6*b* in FIG. 1.

It will be evident from the discussions of FIGS. 4 and 5 that a main theme there is maintaining a sufficiently high temperature at the inlet orifice. FIG. 5A illustrates an embodiment of the invention caring for this concern of temperature maintenance in a unique way. According to this embodiment, the suction tube 6 is relatively short, compared to its length in the embodiments of FIGS. 4 and 5, and the reservoir 130 of molten metal is brought up near to the inlet orifice 60 such that heat transfer from the molten metal in the reservoir keeps the inlet orifice 60 clear of solidified metal. The reservoir is provided in the form of a trough, through which molten metal circulates in a loop as indicated by the arrows. Pumping and heat makeup is effected at station 132. All containers may be covered (not shown) and holes provided for access, for instance for suction tube 6. Metal makeup for the loop comes from the coarse filter 50 of FIG. 3, and the fine filter 54 is provided as shown, in order to effect a continuous filtering of the recirculating metal.

Figure 6:
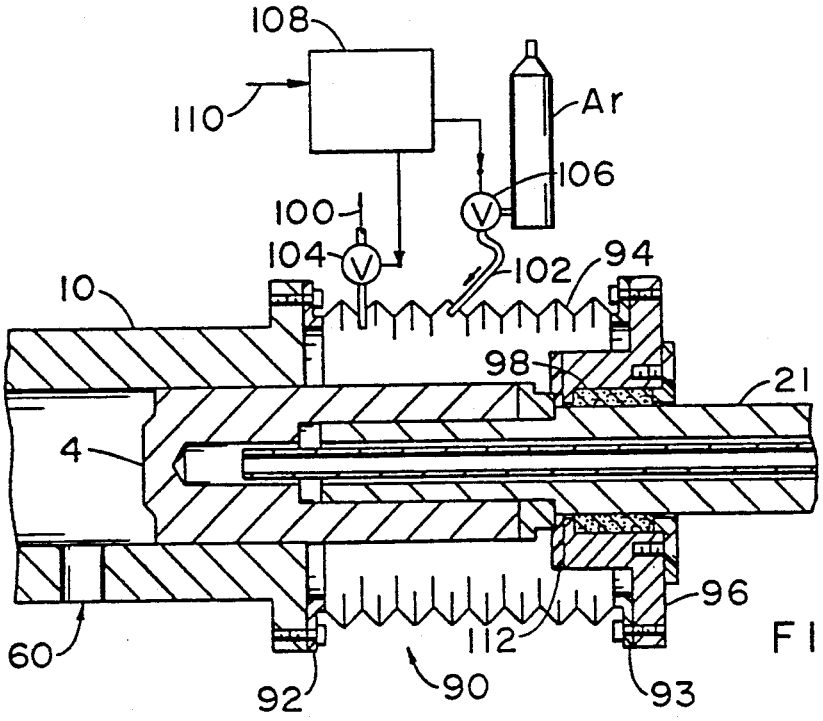
FIG. 6 is an elevational, cross-sectional, detail view of a seal according to the invention for sealing the piston-fill chamber interface.

FIG. 6 illustrates several features of the invention, one feature in particular being an especially advantageous seal for sealing the piston-fill chamber interface against environmental air and dirt.

In FIG. 6, there is shown piston 4 seated in fill chamber 10 at the fill chamber end farthest from the die. Inlet orifice 60 appears in the drawing. It will be evident that the piston as shown in FIG. 6 is in the same, retracted, or rear, position in which it sits in FIG. 1. Rather than, or in addition to, the packing 3 of FIG. 1, the embodiment of FIG. 6 provides a seal 90 extending between the fill chamber 10 and the piston rod 21.

Proceeding from the fill chamber, seal 90 comprises several elements. First, there is a fill chamber connecting ring 92 bolted to the fill chamber. A gasket (not shown) occupies the interface between ring 92 and the fill chamber, for assuring gas tightness, despite any surface irregularities between the two.

Hermetically welded between ring 92 and a follower connecting ring 93 is flexible, air-tight envelope 94. As illustrated, envelope 94 is provided in the form of a bellows. Ring 93 in turn is bolted, also with interposition of a gasket, to piston rod follower 96. An air-tight packing 98 lies between follower 96 and rod 21.

Also forming a part of seal 90 are a line 100 from envelope 94 to a source of vacuum, a line 102 to a source of argon, and associated valves 104, 106, controlled on lines, as shown, by programmable controller 108, to which are input on line 110 signals indicating the various states of the die casting machine.

Seal 90 operates as follows. Follower 96 rides on rod 21 as the piston executes its movement in the bore of fill chamber 10 to and from the die. Either from influences such as banana-like curvature of the bore of fill chamber 10 or due to flexing of the piston rod under the loading of its drive (not shown), and even as influenced by possible articulation of the piston to the piston rod (as provided in embodiments described below), there can be a tendency for the piston rod to want to rotate about axes perpendicular to it. Because of the flexible envelope, these rotational tendencies are easily permitted to occur without adverse effect on the sealing provided by packing 98. The follower simply moves up and down in FIG. 6, or into or out of FIG. 6, to follow the piston rod in whatever way it might deviate from the axes of the piston and fill chamber bore.

With respect to controller 108, it serves the following function. When the piston is in the retracted position as shown, controller 108 holds valve 104 open and valve 106 closed. Vacuum reigns both in the bore of the fill chamber and within envelope 94. The required amount of molten metal enters the bore through inlet orifice 60, whereupon piston rod 21 is driven to move piston 4 forwards toward the die. The supplying of molten metal is terminated as the piston moves into position to close the inlet orifice. If the piston were to move further toward the die such that it would move beyond the inlet orifice and open it to the interior of envelope 94 while the interior were still under vacuum, molten metal would be drawn through the inlet orifice into the interior of the envelope and there solidify, to ruin the envelope. The programmable controller prevents this by using the information on machine state from line 110 to close valve 104 and open valve 106. Argon fills envelope 94 to remove the vacuum and prevent melt from being sucked through inlet orifice 60.

The presence of argon in the system is utilized for monitoring effectiveness of seals. For instance, the tightness of the sliding fit between fill chamber bore and piston may be monitored and/or controlled. Argon sensors in the vacuum lines connected to the die and fill chamber and a knowledge of where argon has been introduced allow tracing and determination of the piston to fill chamber seal.

Figure 6A:
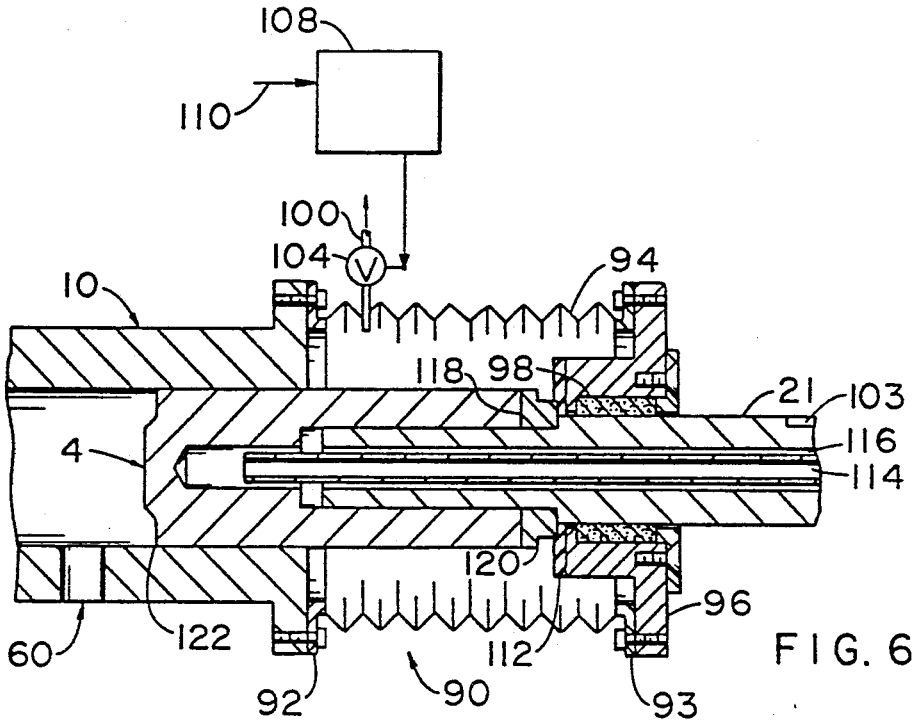
FIGS. 6A and 6B are views as in FIG. 6 of modifications of the seal.
Figure 6B:
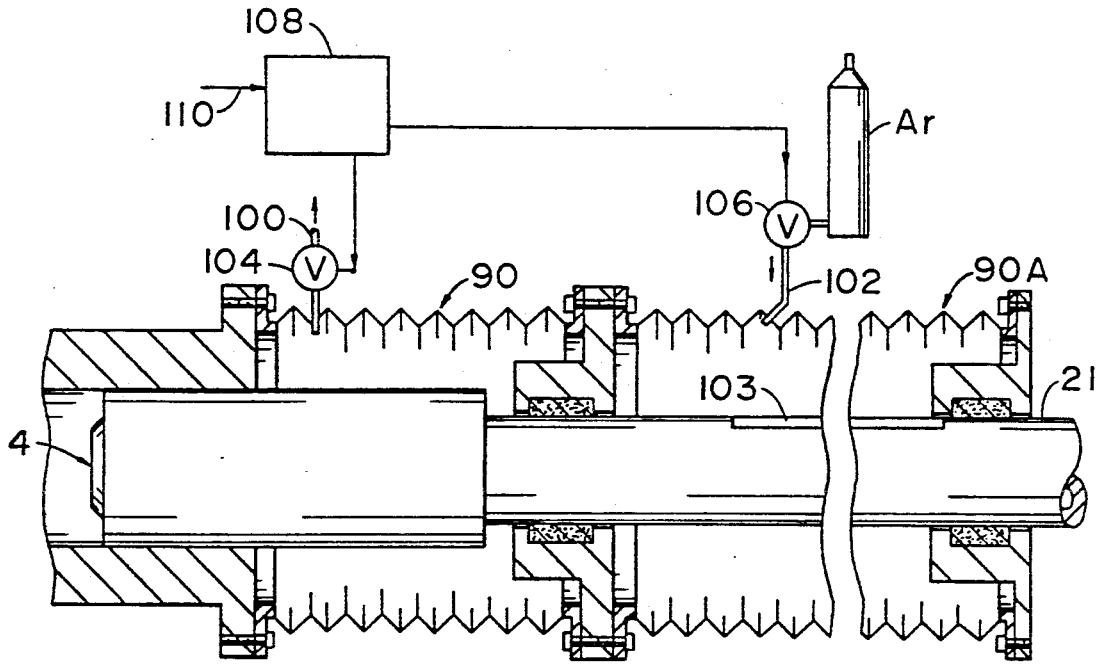

In an alternative embodiment, shown in FIG. 6A line 102 is replaced by one or more longitudinal slots 103 on the outer diameter of piston rod 21 (an alternative or supplement of the effect of slots may be achieved by a reduction in the diameter of the rod). The slots or reduction are placed such that, just as piston 4 is about to clear inlet orifice 60, whereupon molten metal would be sucked into envelope 94, the slots open a bypass of the seal provided by packing 98. The bypass opens to the air of the environment. In the alternative of FIG. 6B, the slot 103 opens to the interior of a duplicate 90A of the structural items 92, 93, 94, 96 and 98 containing argon at atmospheric pressure. The duplicate of 92 is connected to the follower 96 shown in FIG. 6. The envelope of this duplicate structure is chosen sufficiently long that the slot does not open the argon chamber to outside air.

Other features of FIG. 6 include a supplementary seal 112 on follower 96. The piston presses against seal 112 when the piston is in its retracted position.

Also shown in FIG. 6 are the concentric supply and return lines 114, 116 for cooling fluid (for instance, water and ethylene glycol) to the piston. Thermocouples (not shown) in the fill chamber walls, piston metal-contact and bore-contact walls (the leads of these thermocouples are threaded back through the cooling fluid lines), and in the water stream are used for open or closed loop stabilizing of the sliding fit between fill chamber bore and piston. Other factors, such as force needed to move the piston (this being a measure of the friction between bore and piston), or the amount of argon appearing in the vacuum lines connected to die and fill chamber, may as well be used in monitoring and control schemes for stabilizing the sliding fit to minimize gas leakage through the interface between piston and bore.

Another feature of the invention is illustrated in FIG. 6. The back edge of the piston has been provided with a flash, or solder reaction product, remover 118. This remover is made of a harder material which will retain the sharpness of its edge 120 better than the basic piston material which is selected on the basis of other design criteria, such as high heat conductivity. On the piston retraction stroke, remover 118 operates to scrape, or cut, loose flash or solder left during the forward, metal feeding stroke of the piston. Attention is given to keeping the forward edge 122 sharp too, but, as stated, this is an easier task in the case of remover 118.

Figure 7:
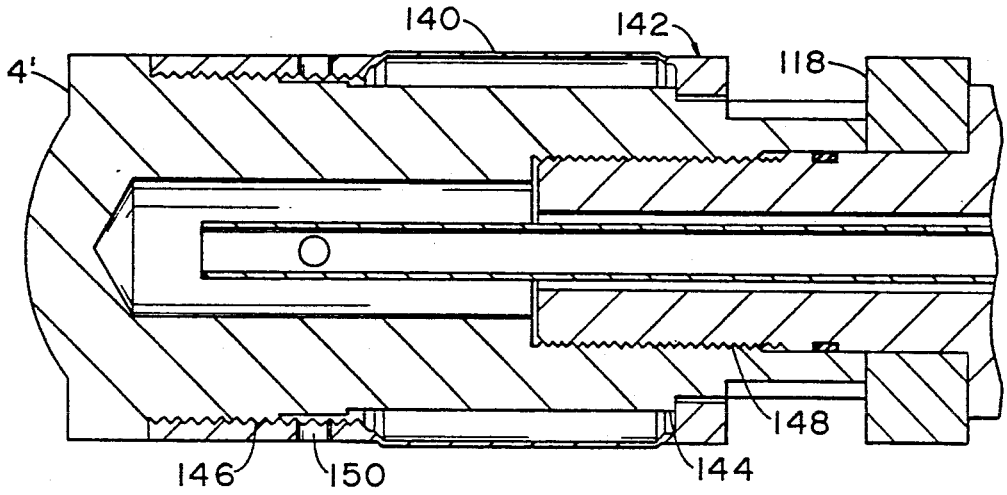
FIG. 7 is an axial cross section of a second embodiment of a piston of the invention.

FIG. 7 shows a second embodiment of a piston according to the invention. This piston, numbered 4' to indicate the intent that it serve as a replacement for piston 4, includes a flexible skirt 140 for fitting against variations in the bore of the fill chamber.

Skirt 140 is made, for instance, of the same material as the piston itself. It is flexible in that it is thin compared to the rest of the piston and it is long. Its thickness may be, for example 0.015 inches, all of which stands out beyond the rest of the piston; i.e. outer diameter of the skirt is e.g. 0.030 inches greater than the outer diameter of the rest of the piston. Preferably, the skirt has an outer diameter about 0.001 inch greater than the inner diameter of the bore of fill chamber 10; i.e. there is nominally a slight interference fit is the skirt with the bore. The flexibility of the skirt avoids any binding.

It will be understood that skirt 140 is relatively weak in compression. In order that solder buildup, or flash, not collapse the skirt on the rearwards stroke of the piston, the skirt includes a hem 142. The inner diameter of hem 142 is less than that of a neighboring shelf 144 on the body of the piston. Should the skirt encounter any major resistance on the rearwards piston stroke that would otherwise compressively load the skirt, the hem transfers such loading to the body of the piston and thus protects the skirt from any danger of collapse.

Threading at 146 and 148 is used for assembling the piston. Holes 150 provide for use of a spanner wrench.

Before assembly, metal spinning techniques may be used to provide an outwards bulging of the thin portion of skirt 140. Metal spinning involves rotating the skirt at high speed about its cylindrical axis and bringing a forming tool, for instance a piece of hardwood, into contact with the interior of the thin portion of skirt 140, to expand the diameter outwards. While this acts to increase the nominal interference with the fill chamber bore, the thinness of the material prevents binding of the piston in the bore. This added bulging increases the sealing effect of the skirt.

Figure 8:
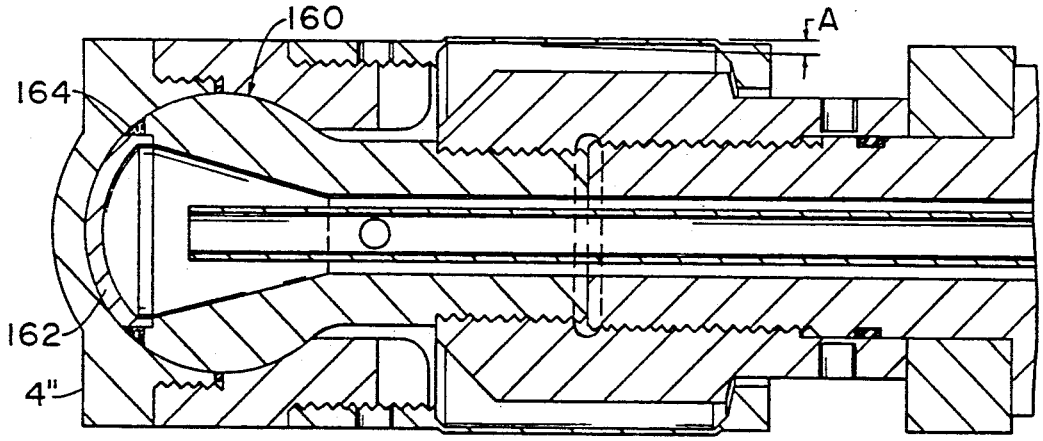
FIG. 8 is an axial cross section of a third embodiment of a piston of the invention.

FIG. 8 shows a third embodiment of a piston according to the invention. This piston 4" provides some features in addition to those shown for piston 4' in FIG. 7. For instance, piston 4" includes a ball-, or swivel-, joint articulation 160 of the piston rod to the piston. This includes a spherical-segment cap 162 welded in place along circular junction 164 to assure containment of cooling fluid.

The hem and shelf facing surfaces in FIG. 8 are machined as conical surfaces in FIG. 8 for providing improved reception as the skirt deflects up to approximately 0.90° maximum rotation, as indicated at A in the drawing.

Figure 9:
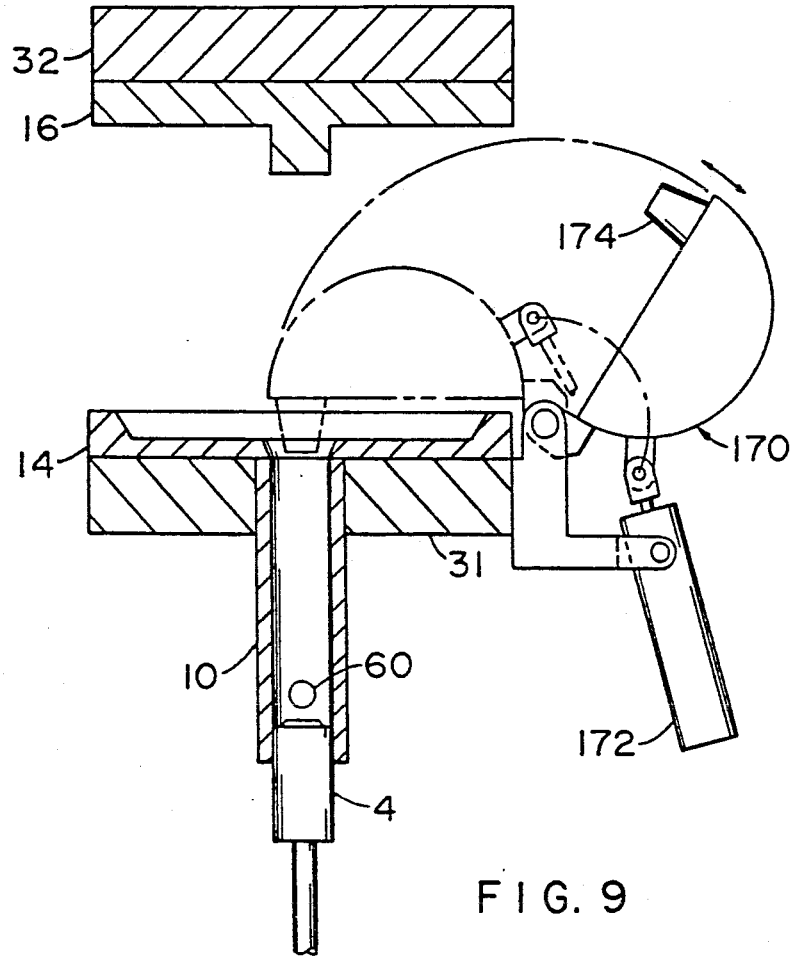
FIG. 9 is a cross sectional, plan, schematic view of the die-casting machine as seen using a horizontal cutting plane in FIG. 1 containing the axis of the fill chamber 10.

FIG. 9 shows a general view of the die-end lubricator 170 of the invention. It is attached to the fixed clamping plate 31 and can be rotated by hydraulic or pneumatic cylinder 172 into the operative position shown by the dot-dashed representation when the die halves have been opened. In the operative position, nozzle 174 is ready to be run into the fill chamber bore to execute its applicator, drying, and sweeping functions.

Figure 10:
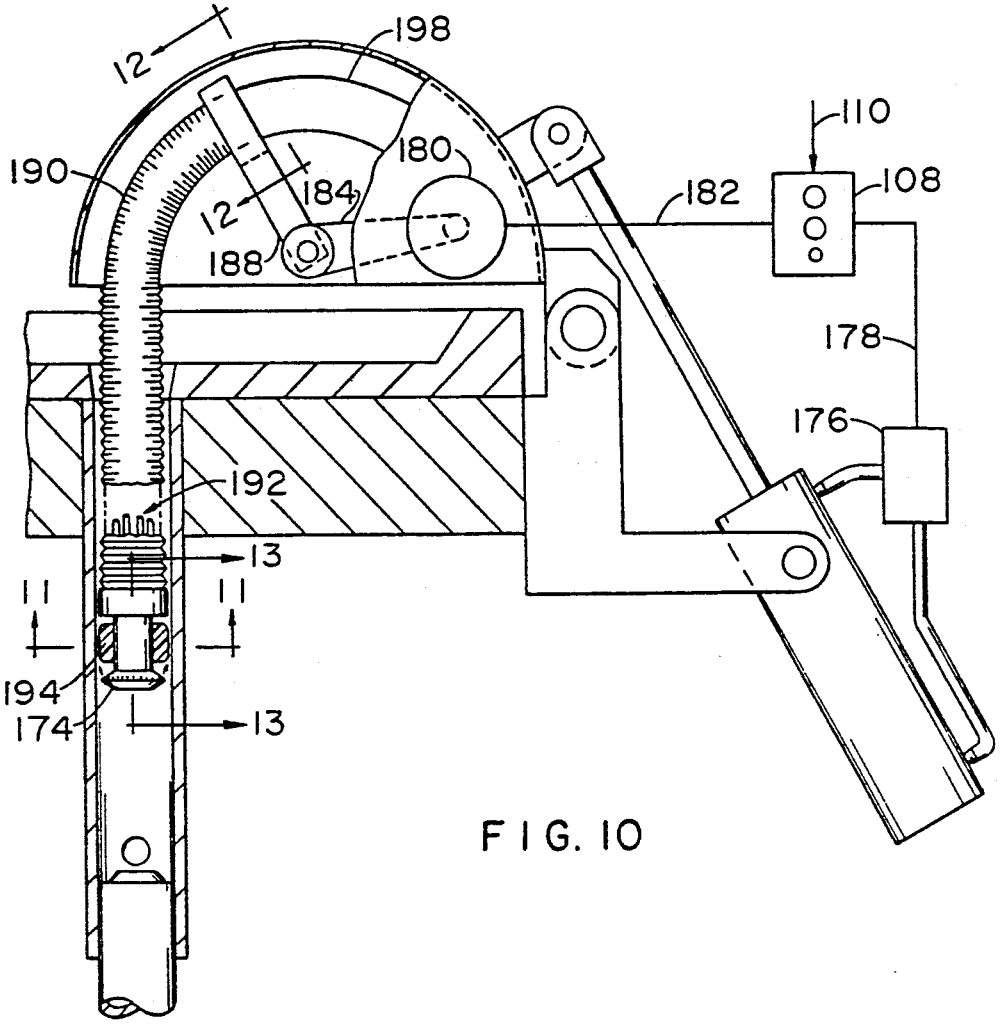
FIG. 10 is a view as in FIG. 9, showing more detail and a subsequent stage of operation.

FIG. 10 shows the die-end lubricator in greater detail. Programmable controller 108 has already received information from the die-casting machine via line 110 that the machine is in the appropriate state (i.e. the die halves are open and the last casting has been ejected) and has interacted with the fluid pressure unit 176 via line 178 to cause the hydraulic cylinder to move the lubricator into its operative position.

Additionally, the controller has subsequently instructed servo-motor 180 on line 182 to drive timing belt 184, thereby turning pulley 186 and the arm 188 rigidly connected to the pulley, in order that the nozzle 174 has moved into the bore of fill chamber 10.

Interconnection of nozzle 174 to arm 188 involves e.g. a length of flexible tubing 190 which carries four tubes 192, hereinafter referenced specifically 192*a*, 192*b*, 192*c* and 192*d*, which serve various purposes to be explained.

Figure 11:
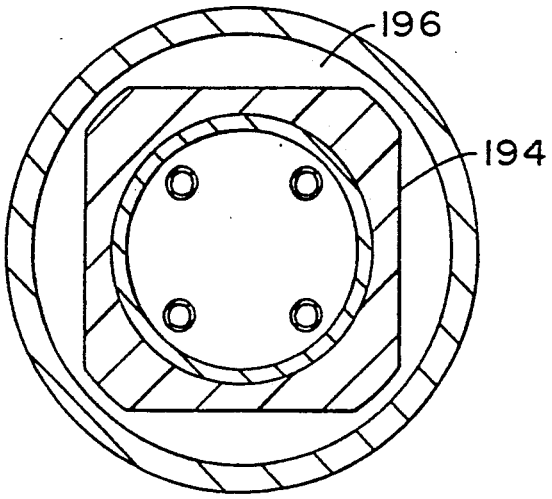
FIG. 11 is a view based on cutting plane 11—11 of FIG. 10.

Nozzle 174 carries a polytetrafluoroethylene (PTFE) collar 194 to guide it in the bore of the fill chamber 10. The collar has a generally polygonal cross section, for example the square cross section shown in FIG. 11, and it only contacts the bore at the polygonal corners, thus leaving gaps 196 for purposes which will become apparent from what follows.

Figure 12:
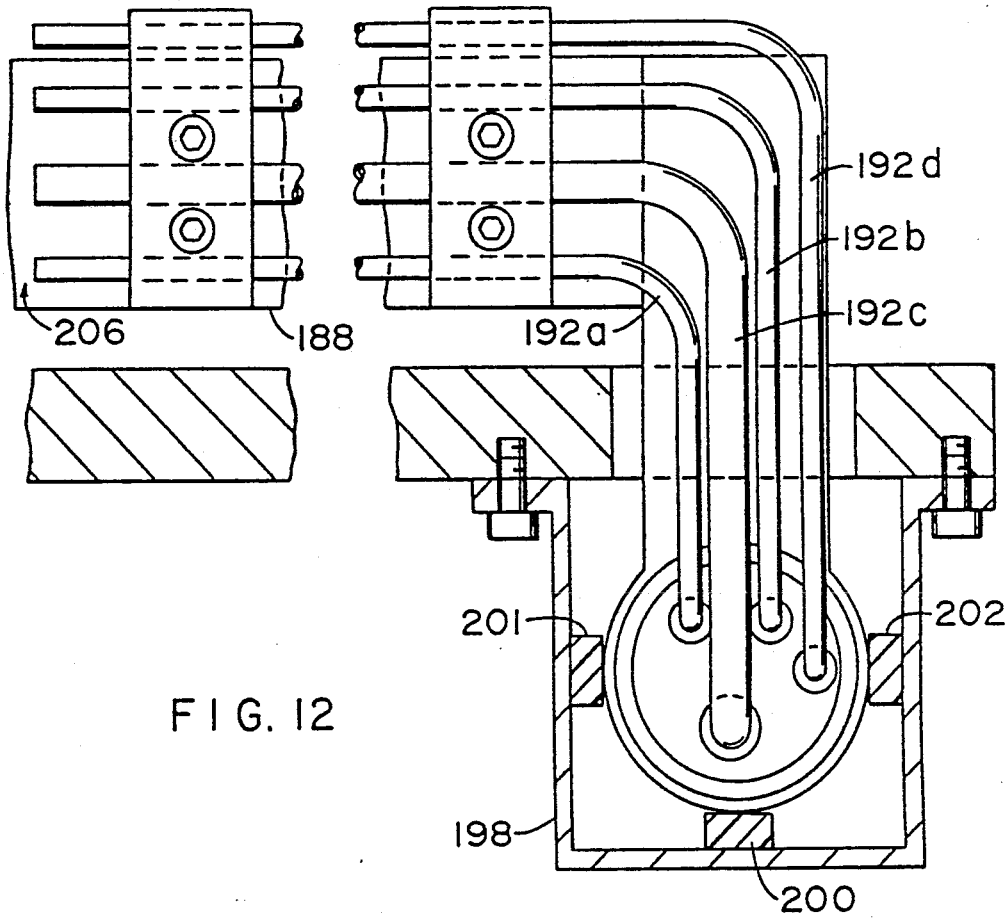
FIG. 12 is a view based on cutting plane 12—12 of FIG. 10.
Figure 15:
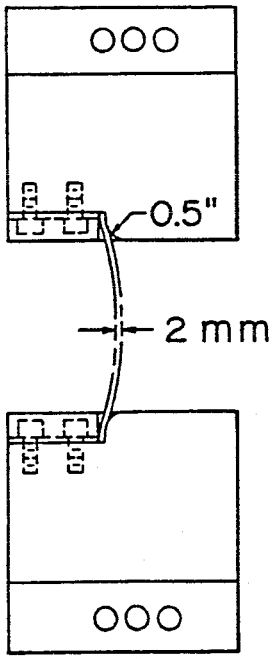
FIG. 15 is an elevational view of the test setup for measuring free bend test deformation.

FIG. 12 shows that the flexible conduit 190 is constrained to move in a circular path by channel 198 containing PTFE tracks 200, 201, 202, as it is driven by arm 188. FIG. 12 also shows the four tubes which will now be specified. Tubes 192*a* and *b* are feed and return lines for e.g. water-based lubricant or coating supply to nozzle 174. Tube 192*c* is the nozzle air supply, and tube 192*d* is a pneumatic power supply line for a valve 204 (FIG. 13) in nozzle 174. The tubes 192 extend between nozzle 174, through the conduit 190, to their starting points at location 206 inwards toward the pivot point for arm 188. At location 206, flexible tubing (not shown) is connected onto the tubes 192, the flexible tubing extending to air and lubricant supply vessels (not shown).

Figure 13:
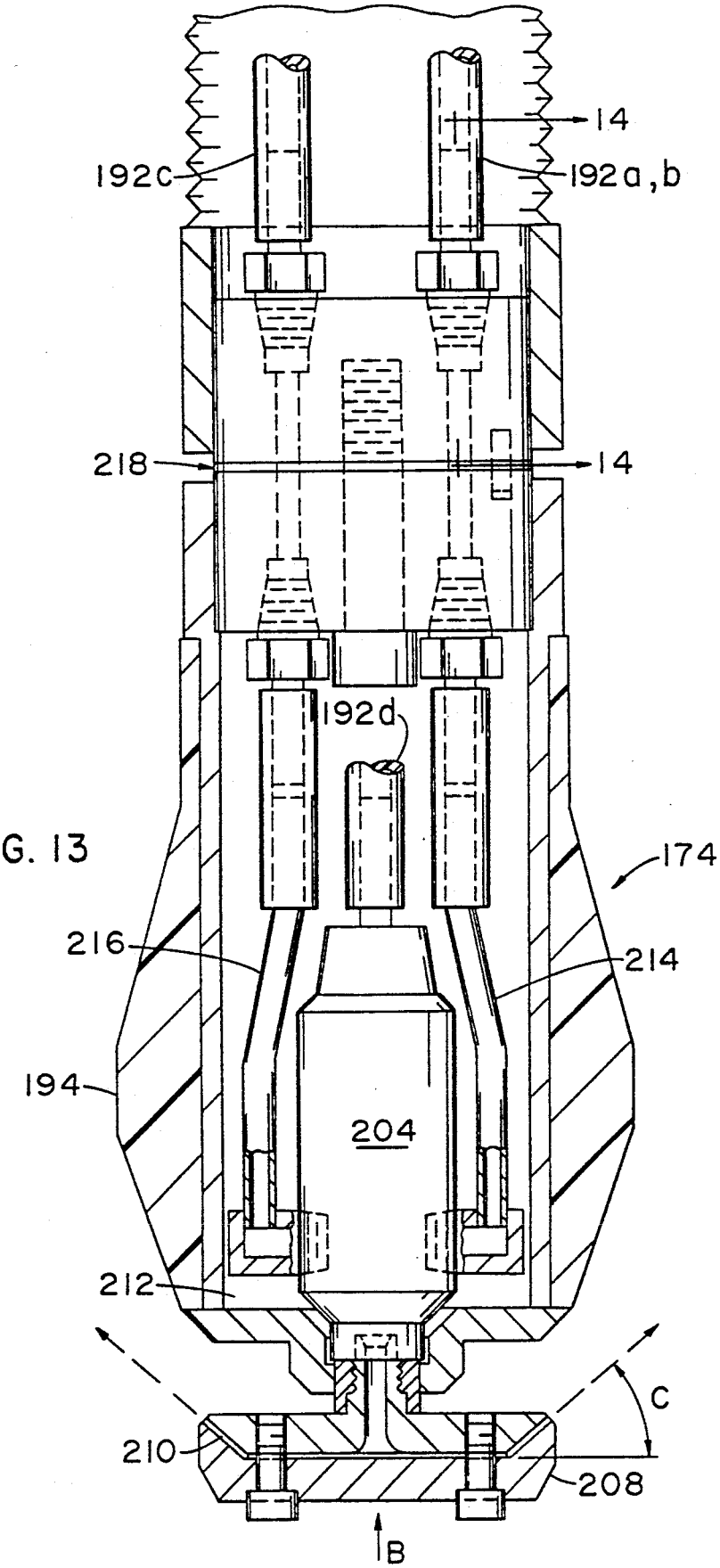
FIG. 13 is a view based on cutting plane 13—13 of FIG. 10.

FIG. 13 shows greater detail for the nozzle 174 of the die-end lubricator. Nozzle head 208, which is circular as viewed in the direction of arrow B, has a sufficient number of spray orifices 210 distributed around its circumference that it provides an essentially continuous conical sheet of backwardly directed spray. An example for a nozzle head diameter of 2.25 inches is 18 evenly spaced orifices each having a bore diameter of 0.024 inches. Angle C is preferably about 40°. Angles in the range of 30° to 50°, preferably in the range 35° to 45°, may serve for purposes of the invention.

The nozzle making chamber 212 receives e.g. water-based lubricant or coating from tube 214 and air from tube 216, or just air from tube 216, depending on whether valve 204 has opened or closed tube 214 as directed by pneumatic line 192*d*.

Figure 14:
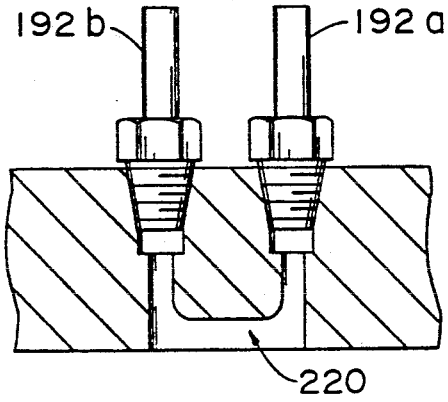
FIG. 14 is a view based on cutting plane 14—14 of FIG. 13.

The nozzle 174 is joined to the flexible tubing at junction 218. Line 192*c* goes straight through to tube 216. Lines 192*a* and *b* are short-circuited at the junction, in order to provide for a continual recirculating of lubricant or coating, this being helpful for preventing settling of suspensions or emulsions. The short-circuiting 220 is shown in FIG. 14. Tube 214 is continually open to the short-circuit, but only draws from that point as directed by valve 204, at which time controller 108 causes a solenoid valve (not shown) in the return line to close, in order to achieve maximum feed of lubricant or coating to the nozzle.

Programmable controller 108 of FIG. 10 interacts with the pneumatic pressure supply for line 192*c* to send air to open valve 204, such that a lubricant or coating aerosol is sprayed onto the bore of the fill chamber as the nozzle moves toward the die in the bore. The controller does not operate the servo-motor to drive the nozzle so far that it would spray lubricant down the inlet orifice 60. The nozzle is stopped short of that point, but sufficient aerosol is expressed in the region that part of the bore at the inlet orifice does get adequately coated. The controller additionally provides the ability to vary nozzle speed along the bore, in order to give trouble points more coating should such be desired.

Once the nozzle has gone as far as it should go, just short of the inlet orifice, it is then retracted. During retraction, the controller has caused pneumatic valve 204 to turn the lubricant, coating, supply off, so that only air from line 192*c*, tube 216, exits through the orifices 210. This air drys water from water-based lubricant, coating, on the bore, and sweeps it, in gasified form, together with loose solder, or flash, from the bore. When the nozzle is back in its retracted position, as shown by the dot-dashed representation in FIG. 9, controller 108 then operates cylinder 172 to swing the lubricator back out of the way, the die halves are closed, and the die-casting machine is ready to make the next casting.

The gaps 196 allow space such that the gas flow out of the nozzle can escape at the die end of the fill chamber.

We claim:

1. A method of vacuum die casting an aluminum alloy comprising less than about 0.5% iron, said method comprising: applying to at least one of a die and fill chamber of the die casting machine a water-based lubricating fluid comprising water, a halogenated salt and a lubricating species which produces a gas when exposed to molten alloy, evaporating the water from the applied lubricating fluid, applying a vacuum to the fill chamber and die to evacuate air and draw molten alloy into the fill chamber, sealing said fill chamber to prevent sucking air into said fill chamber, and charging the molten alloy in the fill chamber into the die at gate velocities of at least about 50 feet (15 meters) per second to form in the die a cast product, said lubricating fluid comprising said lubricating species at a concentration no more than that which results in a gas content of less than about 10 ml/100 g of alloy in said cast product, said lubricating fluid comprising said halogenated salt at a concentration sufficient to substantially inhibit soldering of said alloy to said die or fill chamber.

2. The method of claim 1 wherein said halogenated salt is potassium iodide at a concentration of about 0.5 to 3% by weight in the die and about 2 to 7% by weight in the fill chamber.

3. The method of claim 1 including at least one of the further steps of heat treating and welding said cast product.

4. The method of claim 1 wherein the halogenated salt is a halogenated salt of an alkali metal.

5. The method of claim 4 wherein the halogenated salt of an alkali metal is potassium iodide.

6. The method of claim 4 wherein said alloy is an aluminum alloy comprising less than about 0.5% iron and wherein at least one of said die and fill chamber wall comprises iron, and including die casting said alloy at gate velocities of at least 50 feet (15 meters) per second.

7. The method of claim 4 wherein said lubricant comprises about 0.5 to 7% by weight of said halogenated salt of an alkali metal.

8. The method of claim 6 comprising lubricating the die and the walls of the fill chamber of the vacuum die-casting machine with a water-based lubricant comprising about 0.5 to 7% by weight of potassium iodide.

9. The method of claim 8 wherein said die is lubricated with a water-based lubricant comprising about 0.5 to 3% by weight of potassium iodide.

10. The method of claim 9 wherein the water-based lubricant comprises about 1% by weight of polyethylene glycol.

11. The method of claim 8 wherein said walls of said fill chamber are lubricated with a water-based lubricant comprising about 2 to 7% by weight potassium iodide.

12. The method of claim 11 wherein the water-based lubricant comprises about 1% polyethylene glycol.

13. A vacuum die-casting machine including, a fill chamber having a bore into which molten metal is drawn by a vacuum, a piston slidably in said bore of the fill chamber to charge said molten metal into a die on a forward stroke of the piston, a thin flexible elongated generally cylindrical skirt seal between said piston and the bore of said fill chamber and having a forward edge secured to said piston and a floating rearward edge, said thin flexible elongated cylindrical skirt seal having a diameter which provides sealing engagement with the bore of the fill chamber.

14. The vacuum die-casting machine of claim 13 including a rigid annular hem ring secured to said rearward edge of said thin flexible elongated cylindrical skirt seal and having a peripheral rearwardly facing cutting edge which strips flash and debris from the bore of said fill chamber on a rearward stroke of said piston.

15. The vacuum die-casting machine of claim 14 wherein said piston has a generally rearwardly facing annular shoulder with a preset outer diameter and said annular hem ring has an inner diameter less than said preset outer diameter of said shoulder, said hem ring axially engaging said shoulder to transfer to the piston rather than the thin flexible elongated cylindrical skirt seal loading generated by resistance to rearward movement of the hem ring with the rearward stroke of the piston.

16. The vacuum die-casting machine of claim 15, wherein said shoulder and hem ring have generally conical engagement surfaces extending radially outward and forward.

17. The vacuum die-casting machine of claim 14 wherein said piston has a rearwardly facing socket and including a piston rod having on one end a ball which seats in said socket to effect an articulated connection between said piston and said piston rod, said piston rod having a rearwardly facing shoulder having an outward diameter greater than an inner diameter of said hem ring, said hem ring axially engaging said shoulder, on said piston rod to transfer to the piston rod rather than the thin flexible elongated cylindrical skirt seal loading generated by resistance to rearward movement of the hem ring with the rearward stroke of the piston.

18. The vacuum die-casting machine of claim 17 wherein said shoulder and hem ring have conical engagement surfaces extending radially outward and forward.

19. The vacuum die-casting machine of claim 13 wherein said thin flexible elongated cylindrical skirt seal is made of the same material as said piston.

20. A vacuum die-casting machine including a die, a fill chamber having a bore, a piston slidable in said bore of the fill chamber to charge molten metal into said die on a forward stroke of said piston, said piston having a generally rearwardly facing shoulder having a preset outer diameter, a thin flexible elongated cylindrical skirt seal between said piston and the bore of said fill chamber made of the same material as said piston and having a forward edge secured to said piston and a floating rearward edge, said thin flexible elongated cylindrical skirt seal having a diameter which provides an interference fit with the bore of said fill chamber, and an annular hem ring having a rearward facing peripheral cutting edge and an inner diameter less than said outer diameter of the shoulder on said piston, said annular hem ring being secured to said rearward edge of said skirt and engaging said shoulder on said piston to transfer loading produced by resistance to rearward movement of the cutting edge upon rearward movement of the piston to the piston rather than to the flexible skirt.

21. The vacuum die-casting machine of claim 20 wherein said shoulder on the piston and said hem ring have conical engagement surfaces extending radially outward and forward.

22. A method of checking seals in a vacuum die-casting machine having a piston slidable in a fill chamber bore with a sliding fit forming a seal, said method comprising:

introducing a trace gas adjacent one end of said piston, monitoring for the presence of said trace gas adjacent the other end of said piston, and adjusting said sliding fit to reduce the amount of trace gas monitored.

23. The method of claim 22 wherein said trace gas is argon.

24. In a die-casting machine having a fill chamber with a bore for communicating with a die, a piston slidable in said fill chamber and a piston rod for moving said piston in the fill chamber bore to inject molten metal into said die, the improvement wherein said piston comprises a cylindrical body and an end wall which together define an internal spherical socket, and wherein said piston rod terminates in a ball which seats in said spherical socket to effect an articulated connection which accommodates for variations in alignment between said piston and said piston rod, said ball having a fully enclosed chamber defined in part by a spherical sector end wall which rotatably engages said end wall of said piston, said piston rod having passages communicating with said fully enclosed chamber in said ball for circulating coolant through said chamber to cool said piston including the end wall of said piston.

25. The die-casting machine of claim 24 wherein said fully enclosed chamber in said ball is generally cone shaped and diverge toward said spherical sector end wall of the ball, and wherein said passages are coaxial and extend longitudinally through said piston rod with an inner passage formed by a conduit extending axially into said cone shaped fully enclosed chamber toward but short of said spherical sector end wall and through which coolant is directed at said spherical sector end wall and into said fully enclosed chamber.

26. The die-casting machine of claim 24 including a thin flexible elongated cylindrical skirt seal having a forward edge secured to said cylindrical body of said piston and extending axially rearward beyond said piston and terminating in a free floating rear edge radially outward of said piston rod, a rigid annular hem ring secured to said free floating rear edge to said thin flexible elongated cylindrical skirt seal and having a peripheral rearwardly facing cutting edge which strips flash and debris from the bore of said fill chamber on a rearward stroke of said piston, said piston rod having a generally rearwardly facing shoulder which is axially engaged by said hem ring to transfer to the piston rod rather than said thin flexible elongated cylindrical skirt seal loading generating by resistance to rearward movement of said hem ring with the rearward stroke of the piston.

27. The die-casting machine of claim 26 wherein said shoulder on said piston rod and said hem ring have generally conical engagement surfaces extending outward and forward.

28. A vacuum die-casting machine including a fill chamber having a longitudinal bore and an inlet opening extending generally transversely through a wall of the fill chamber into said bore, a feed tube seated in the inlet opening, means drawing a vacuum in said fill chamber bore to draw molten metal through said feed tube into said fill chamber bore, and heater means in surface contact with the wall of said fill chamber surrounding said feed tube, said heater means comprising an annular housing with an annular groove in one face thereof, an electrical coil in said annular groove, and means clamping said annular housing against said fill chamber wall surrounding the feed tube with said one face with said annular groove therein containing said electrical coil abutting the wall of said fill chamber.

29. A vacuum die-casting machine including a fill chamber having a longitudinal bore and an inlet opening extending generally transversely through a wall of the fill chamber into said bore, a feed tube seated in said inlet opening, means drawing a vacuum in said fill chamber bore to draw molten metal through said feed tube into said fill chamber bore, a primary vacuum seal between said feed tube and said inlet opening and a redundant secondary vacuum seal in series with said primary vacuum seal between said feed tube and said inlet opening, said primary vacuum seal and secondary vacuum seal each sealing against at least partially axially facing sealing surfaces and one of said primary and secondary seals being crushable to assure sealing of both seals.

30. A vacuum die-casting machine including a fill chamber having a longitudinal bore and an inlet opening extending generally transversely through a wall of the fill chamber into said bore, said inlet opening having an inner radial shoulder and an outer axially and radially inclined shoulder axially spaced a preset distance from the inner radial shoulder, a feed tube seated in said inlet opening and having an end face aligned with the inner radial shoulder of the inlet opening and a radially outward shoulder aligned with the outer shoulder of the inlet opening and axially spaced substantially said preset distance form the end face, means drawing a vacuum in said fill chamber bore to draw molten metal through said feed tube into said fill chamber bore, a primary vacuum seal located between said end face of the feed tube and the inner radial shoulder of said inlet opening, and a redundant secondary vacuum seal in series with said primary vacuum seal and located between the other axially and radially inclined shoulder of the inlet opening and the radially outward shoulder of said feed tube, one of said primary and secondary vacuum seals being crushable to assure sealing of both seals.

31. The die-casting machine of claim 30 including cylindrical insert means extending through the wall of said fill chamber in said inlet opening and having radially outward shoulder means positioned between the inner radial shoulder of said inlet opening said end face of the feed tube, and including a first primary seal between said shoulder means and said inner radial shoulder in said inlet opening and a second primary seal between said shoulder means and said end face of the feed tube.

* * * * *

UNITED STATES PATENT AND TRADEMARK OFFICE

CERTIFICATE OF CORRECTION

PATENT NO. : 5,076,344

DATED : December 31, 1991

INVENTOR(S) : James R. Fields, et al.

It is certified that error appears in the above-identified patent and that said Letters Patent is hereby corrected as shown below:

On title page, item [75], should read as follows:
--James R. Fields, Export; Lawrence W. Cisko, Irwin; George C. Full, Murrysville: Thomas J. Kasun, Pittsburgh; Robert C. Wallace, New Kensington, all of Pa.--

Column 15, line 7, change "making" to --mixing--.

Column 18, line 12, Claim 25, change "diverge" to --diverges--.

Column 18, line 26, Claim 26, after "edge" change "to" to --of--.

Column 19, line 14, Claim 30, change "form" to --from--.

Column 20, line 12, Claim 31, after "opening" insert --and--.

Signed and Sealed this

Twenty-fourth Day of August, 1993

Bruce Lehman

*Attest:*

BRUCE LEHMAN

*Attesting Officer*

*Commissioner of Patents and Trademarks*